US008136338B2

(12) United States Patent
Huang

(10) Patent No.: US 8,136,338 B2
(45) Date of Patent: Mar. 20, 2012

(54) DEVICE FOR ASSEMBLING AND DISASSEMBLING A BICYCLE CHAIN

(75) Inventor: Hung-Chen Huang, Chang Hwa (TW)

(73) Assignee: Super B Precision Tools Co., Ltd., Chang Hwa (TW)

( * ) Notice: Subject to any disclaimer, the term of this patent is extended or adjusted under 35 U.S.C. 154(b) by 326 days.

(21) Appl. No.: 12/558,524

(22) Filed: Sep. 12, 2009

(65) Prior Publication Data

US 2011/0061360 A1 Mar. 17, 2011

(51) Int. Cl.
*B25B 13/00* (2006.01)
*B21L 21/00* (2006.01)

(52) U.S. Cl. ..... 59/7; 59/11; 7/138; 29/243.53

(58) Field of Classification Search ..... 59/7, 11; 7/138; 29/243.53
See application file for complete search history.

(56) References Cited

U.S. PATENT DOCUMENTS

| | | | | |
|---|---|---|---|---|
| 2,826,893 | A * | 3/1958 | Falk et al. | 59/7 |
| 4,949,446 | A * | 8/1990 | Kuwica | 29/243.53 |
| 4,988,031 | A * | 1/1991 | Jordan | 59/7 |
| 5,140,736 | A * | 8/1992 | Hsiao | 59/7 |
| 6,748,637 | B2 * | 6/2004 | Meggiolan | 29/257 |
| 7,409,817 | B1 * | 8/2008 | Huang | 59/7 |

* cited by examiner

*Primary Examiner* — David Jones

(57) ABSTRACT

A device for assembling and disassembling a bicycle chain comprises a main body, an actuating member, a rod member, a pulling member, and an elastic plate. The rod member, the pulling member and the elastic plate are connected to one another to guide a positioning member to be assembled into the assembling holes in a balance manner, so that the device for assembling and disassembling a bicycle chain makes the assembly of the chain more convenient and simple.

4 Claims, 11 Drawing Sheets

DEVICE FOR ASSEMBLING AND DISASSEMBLING A BICYCLE CHAIN

BACKGROUND OF THE INVENTION

1. Field of the Invention

The present invention relates to a device for assembling and disassembling a chain; and more particularly to a device for assembling and disassembling a bicycle chain.

2. Description of the Prior Art

Referring to FIG. 1, a conventional device for assembling and disassembling a bicycle chain disclosed in Taiwan Patent No. 96132305 comprises an assembling seat 11, an actuating member 12, a guiding push member 13 and a handle 14.

When the above device for assembling and disassembling a bicycle chain needs to assemble two chains A, the two chains A will be straddled over a positioning protrusion 111 of the assembling seat 11 first, and then the guiding push member 13 will be inserted through a through hole 112 of the assembling seat 11 in such a manner that a guiding portion 131 of the guiding push member 13 is inserted through the assembling holes A1 of the two chains A one by one and positioned therein, subsequently, a positioning member B will be placed between the guiding portion 131 of the guiding push member 13 and a pushing portion 121 of the actuating member 12, and after that, the user will hold the handle 14 with one hand and rotate the actuating member 12 with the other to make the pushing portion 121 push against the positioning member B to force the guiding push member 13 to slide, and finally, the positioning member B will be inserted into the assembling holes A1 of the two chains A. However, this conventional device for assembling and disassembling a bicycle chain still suffers from the following defects:

When the two chains A are assembled, both ends of the positioning member B abut against the pushing portion 121 of the actuating member 12 and the guiding portion 131 of the guiding push member 13, since the guiding push member 13 is only used to be inserted into the through hole 112 of the assembling seat 11 and can freely move but cannot apply a pushing force to pre-position the positioning member B, when assembling the two chains A, the user has to hold the handle 14 or the assembling seat 11 and rotate the actuating member 12 synchronously besides balancing the positioning member B with one hand. Therefore, the above conventional device is inconvenient to use, and thus improvements are indeed needed.

The present invention has arisen to mitigate and/or obviate the afore-described disadvantages.

SUMMARY OF THE INVENTION

The primary objective of the present invention is to provide a device for assembling and disassembling a bicycle chain which utilizes an elastic plate to guide a positioning member to be assembled into the assembling holes of two chains in a balance manner to make the assembly of the bicycle chain more convenient and simple.

In order to achieve the above objective, a device for assembling and disassembling a bicycle chain comprises a main body, an actuating member, a rod member, a pulling member, and an elastic plate. The main body includes a threaded hole, an assembling hole, a sliding hole in communication with the assembling hole, a moving space in communication with the assembling hole and the sliding hole, and an assembling space between the threaded hole and the assembling hole. The actuating member is screwed into the threaded hole. The rod member is inserted into the assembling hole and includes a guiding portion which is located in the assembling hole or the assembling space. The pulling member includes a pulling portion and a connecting portion and is slidably disposed in the sliding hole in such a manner that the pulling portion is located outside the sliding hole, and the connecting portion is connected to the rod member. The elastic plate includes a first end and a second end and is assembled in the moving space. The first end is fixedly connected to the main body, and the second end is connected to the rod member, so that the elastic plate can provide an elastic restoring force to the pulling member and the rod member.

DETAILED DESCRIPTION OF THE PREFERRED EMBODIMENTS

Figure 1:
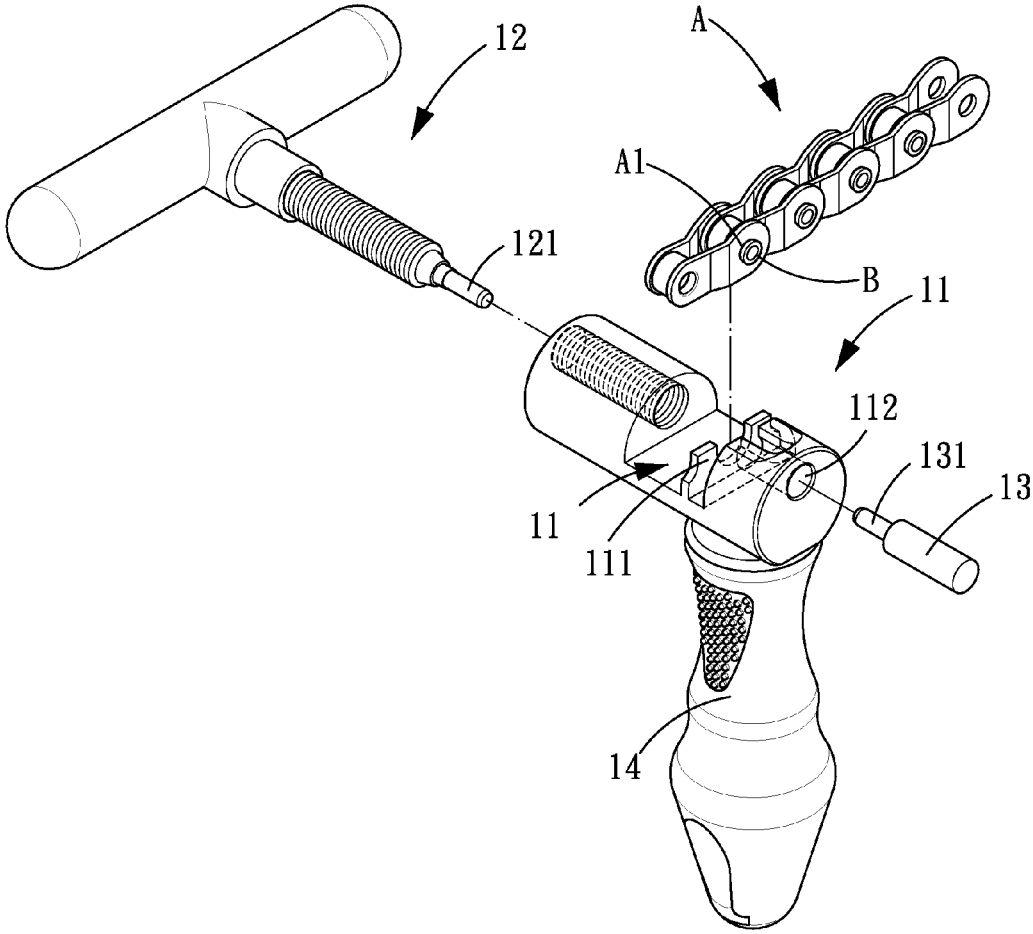
FIG. 1 PRIOR ART
FIG. 1 is a perspective view of a conventional device for assembling and disassembling a bicycle chain.
Figure 2:
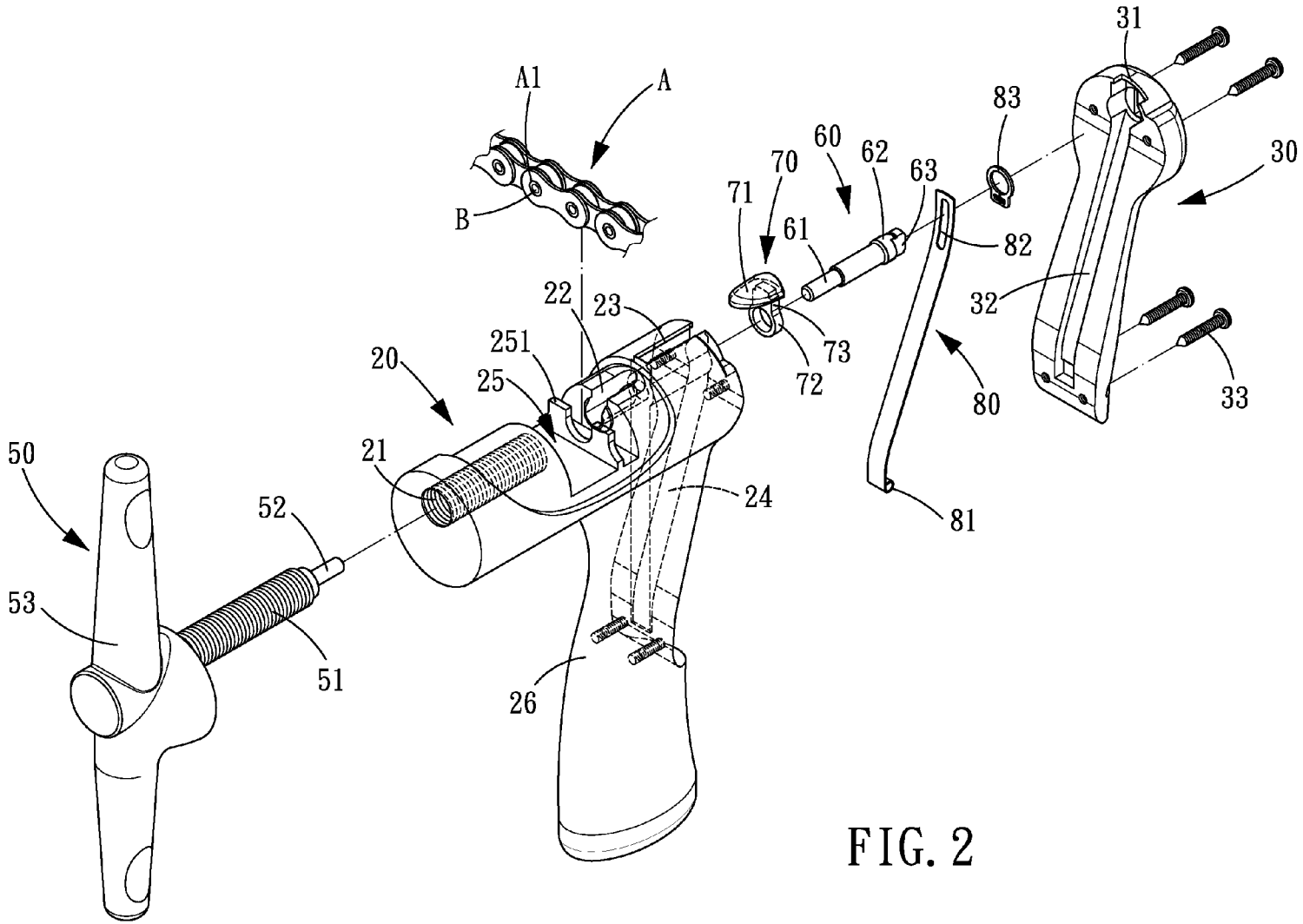
FIG. 2 is an exploded view of a device for assembling and disassembling a bicycle chain in accordance with the present invention.
Figure 3:
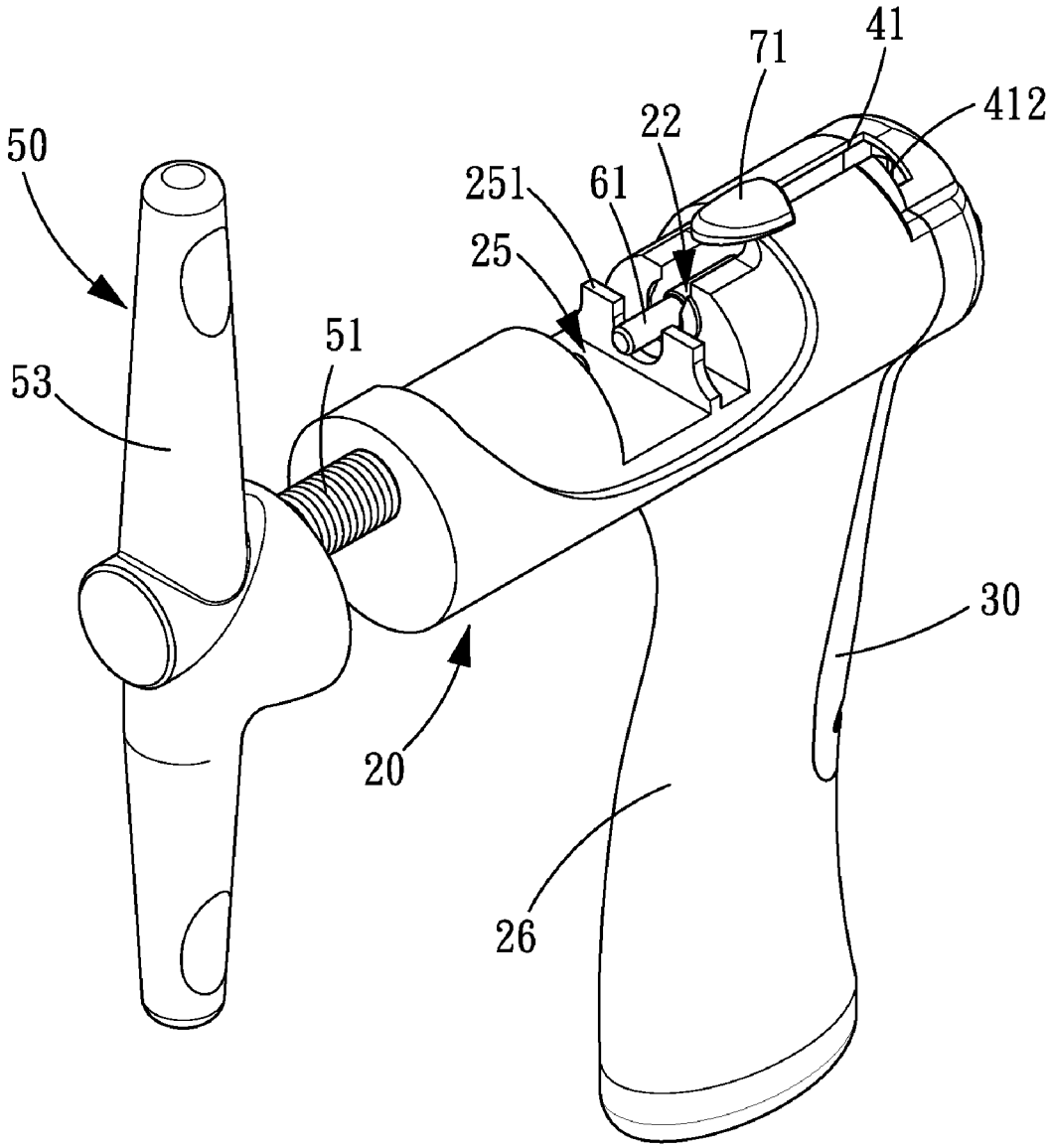
FIG. 3 is an assembly view of the device for assembling and disassembling a bicycle chain in accordance with the present invention.

The present invention will be clearer from the following description when viewed together with the accompanying drawings, which show, for purpose of illustrations only, the preferred embodiment in accordance with the present invention.

Referring to FIGS. 2-5, a device for assembling and disassembling a bicycle chain in accordance with the present invention comprises a main body, an actuating member 50, a rod member 60, a pulling member 70, and an elastic plate 80.

The main body includes an assembling seat 20 and a rear cap 30. The assembling seat 20 includes a threaded hole 21 and an assembling hole 22 that are coaxially arranged. The assembling seat 20 further includes a first sliding groove 23 in communication with the assembling hole 22, a first groove 24 in communication with the assembling hole 22 and the first sliding groove 23, and an assembling space 25 between the threaded hole 21 and the assembling hole 22. The assembling space 25 includes a positioning protrusion 251 for engaging with and positioning a chain. Further, the assembling seat 20 is integrally formed with a handle 26 at a lower end thereof. The rear cap 30 includes a second sliding groove 31 and a second groove 32 in communication with the second sliding groove 31. The rear cap 30 is assembled to the assembling seat 20 by threaded elements 33. The second sliding groove 31 and the first sliding groove 23 define an L-shaped sliding hole 41. The sliding hole 41 includes a first surface 411 and a second surface 412 that are parallel to and staggered with each other. The second groove 32 and the first groove 24 define a moving space 42.

The actuating member 50 is T-shaped and includes a threaded portion 51 to be screwed into the threaded hole 21. One end of the threaded portion 51 is pivotally connected with a pushing member 52. The pushing member 52 is located in the threaded hole 21 or the assembling space 25. The other end of the threaded portion 51 includes an operating portion 53 for controlling the threaded portion 51 to drive the pushing member 52 to move toward or backward from the assembling hole 22 of the assembling seat 20.

The rod member 60 is movably inserted into the assembling hole 22 of the assembling seat 20 and includes a guiding portion 61 at one end thereof. The guiding portion 61 is located in the assembling hole 22 or the assembling space 25. The other end of the rod member 60 includes a limiting portion 62 and an end portion 63 connected to the limiting portion 62.

The pulling member 70 includes a pulling portion 71, a connecting portion 72 in form of a hole, and a neck portion 73 connected to the pulling portion 71 and the connecting portion 72. The pulling member 70 is slidably disposed in the sliding hole 41 in such a manner that the pulling portion 71 is located outside the sliding hole 41. The connecting portion 72 is pivotally connected to the limiting portion 62 of the rod member 60. The neck portion 73 abuts against the first surface 411 or the second surface 412 of the sliding hole 41.

The elastic plate 80 includes a first end 81 and a second end 82 in the form of a hole that are oppositely arranged. The elastic plate 80 is assembled in the moving space 42. The first end 81 is fixedly disposed in the main body, and the second end 82 is connected to the end portion 63 of the rod member 60. On the end portion 63 is further provided a retaining ring 83 in such a manner that the second end 82 of the elastic plate 80 can be retained between the limiting portion 62 of the rod member 60 and the retaining ring 83. The second end 82 is aligned with the connecting portion 72 of the pulling member 70, so that after the pulling member 70 drives the rod member 60 to move toward the rear cap 30, the elastic plate 80 can push the rod member 60 and the pulling member 70 back to their original positions, and as a result, the guiding portion 61 of the rod member 60 is elastically retained in the assembling space 25 when the rod member 60 is not moved, and the neck portion 73 of the pulling member 70 elastically abuts against the first surface 411 when the pulling member 70 is not moved.

The aforementioned is the summary of the positional and structural relationship of the respective components of the preferred embodiment in accordance with the present invention.

Figure 5:
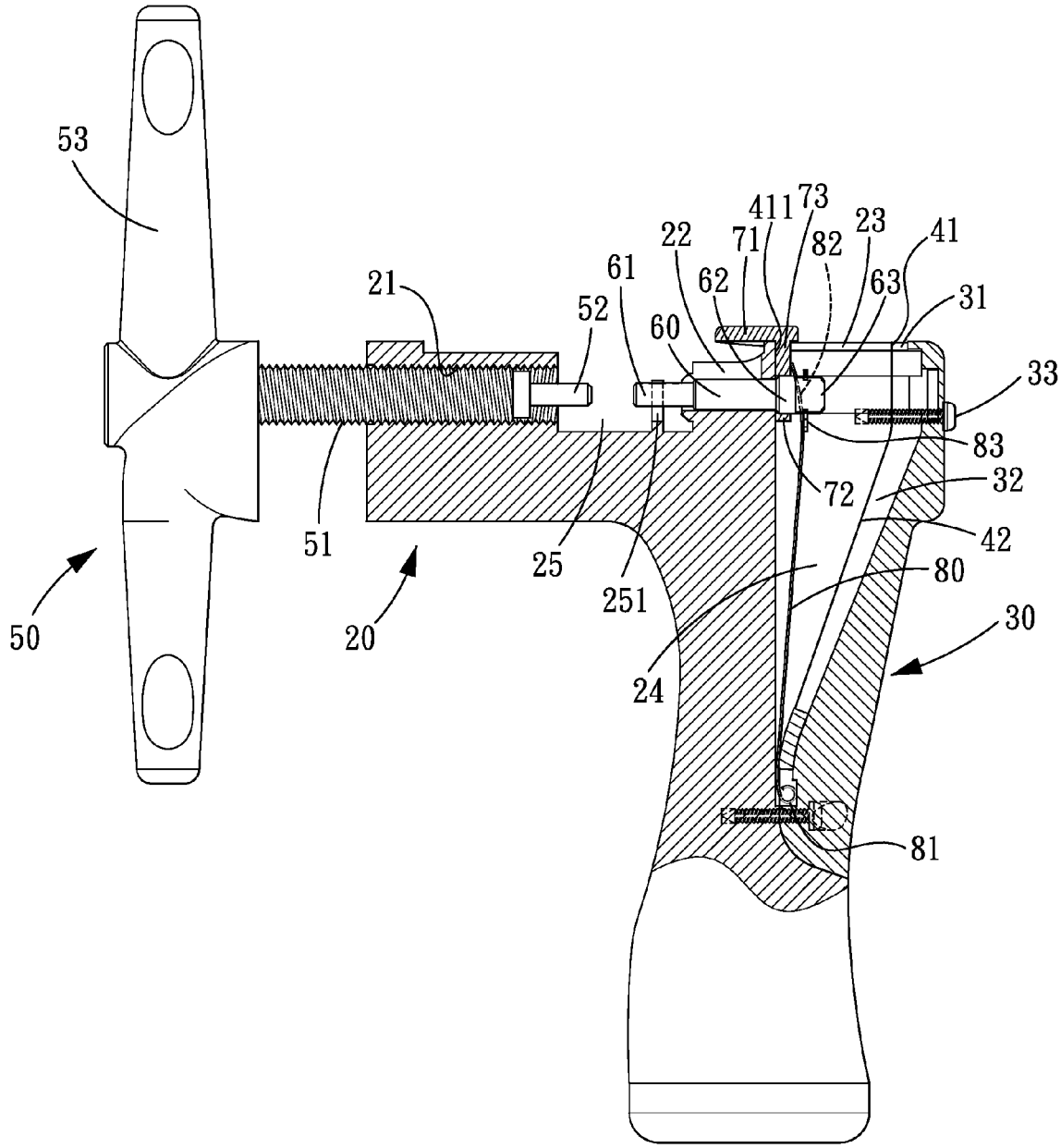
FIG. 5 is a cross-sectional view of the device for assembling and disassembling a bicycle chain in accordance with the present invention.

For a better understanding of the present invention, its operation and function, reference should be made to FIGS. 5-11, wherein FIG. 5 illustrates the device for assembling and disassembling a bicycle chain is in a non-operating state.

Figure 6:
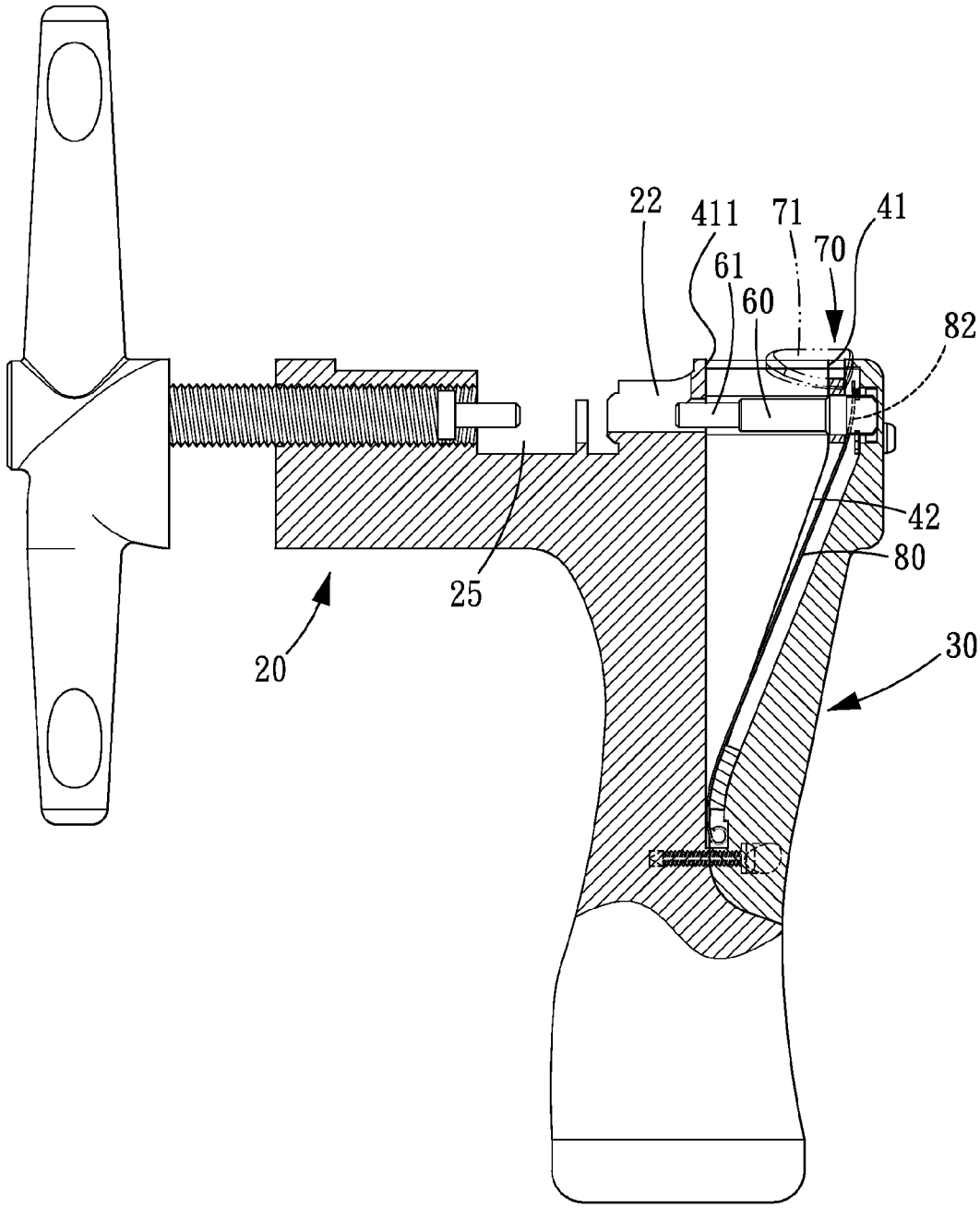
FIG. 6 is an operational view for assembling two chains, showing that the rod member is located at a position ready for assembling the chains.
Figure 7:
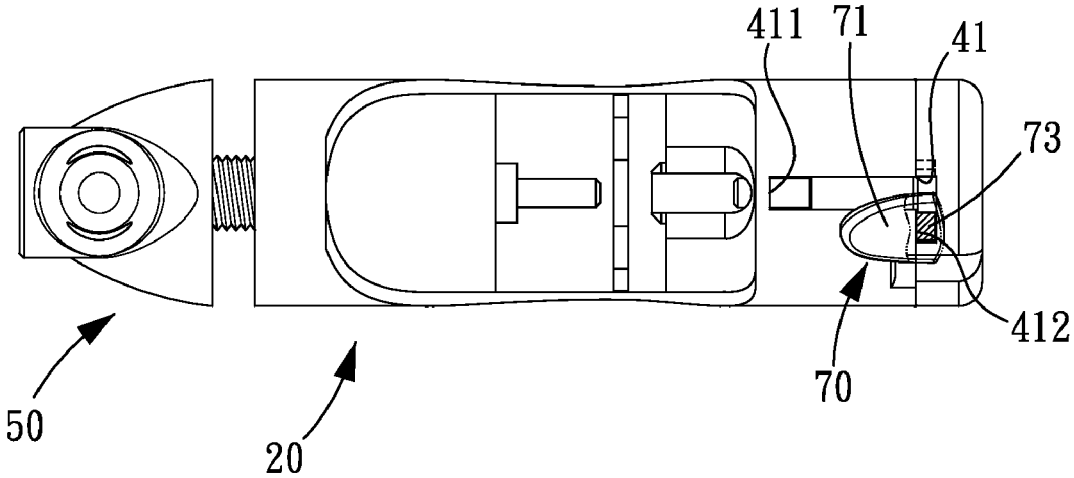
FIG. 7 is a top view of FIG. 6.

To assemble a chain, firstly please refer to FIG. 6, the pulling portion 71 of the pulling member 70 is pressed and pulled toward the rear cap 30 to make the pulling member 70 move away from the first surface 411 of the sliding hole 41 and make the guiding portion 61 of the rod member 60 retract into the assembling hole 22 from the assembling space 25 of the assembling seat 20, at the same moment, the rod member 60 will drive the second end 82 of the elastic plate 80 to rotate toward the rear cap 30 within the moving space 42 to make the elastic plate 80 accumulate an elastic restoring force. At this moment, referring to FIG. 7, the pulling member 70 will be pivoted a certain angle to make the neck portion 73 of the pulling member 70 abut against the second surface 412 of the sliding hole 41, thus temporarily positioning the pulling member 70.

Figure 4:
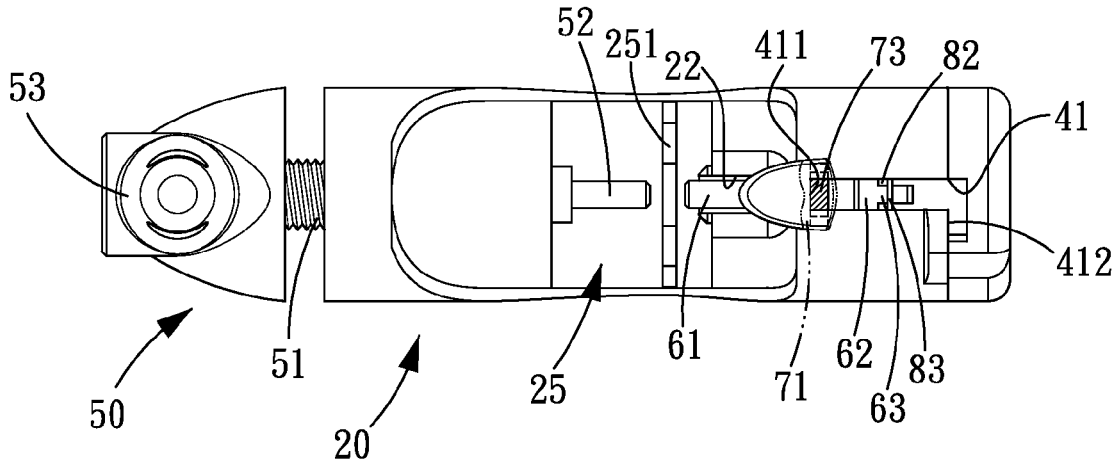
FIG. 4 is a top view of the device for assembling and disassembling a bicycle chain in accordance with the present invention.
Figure 8:
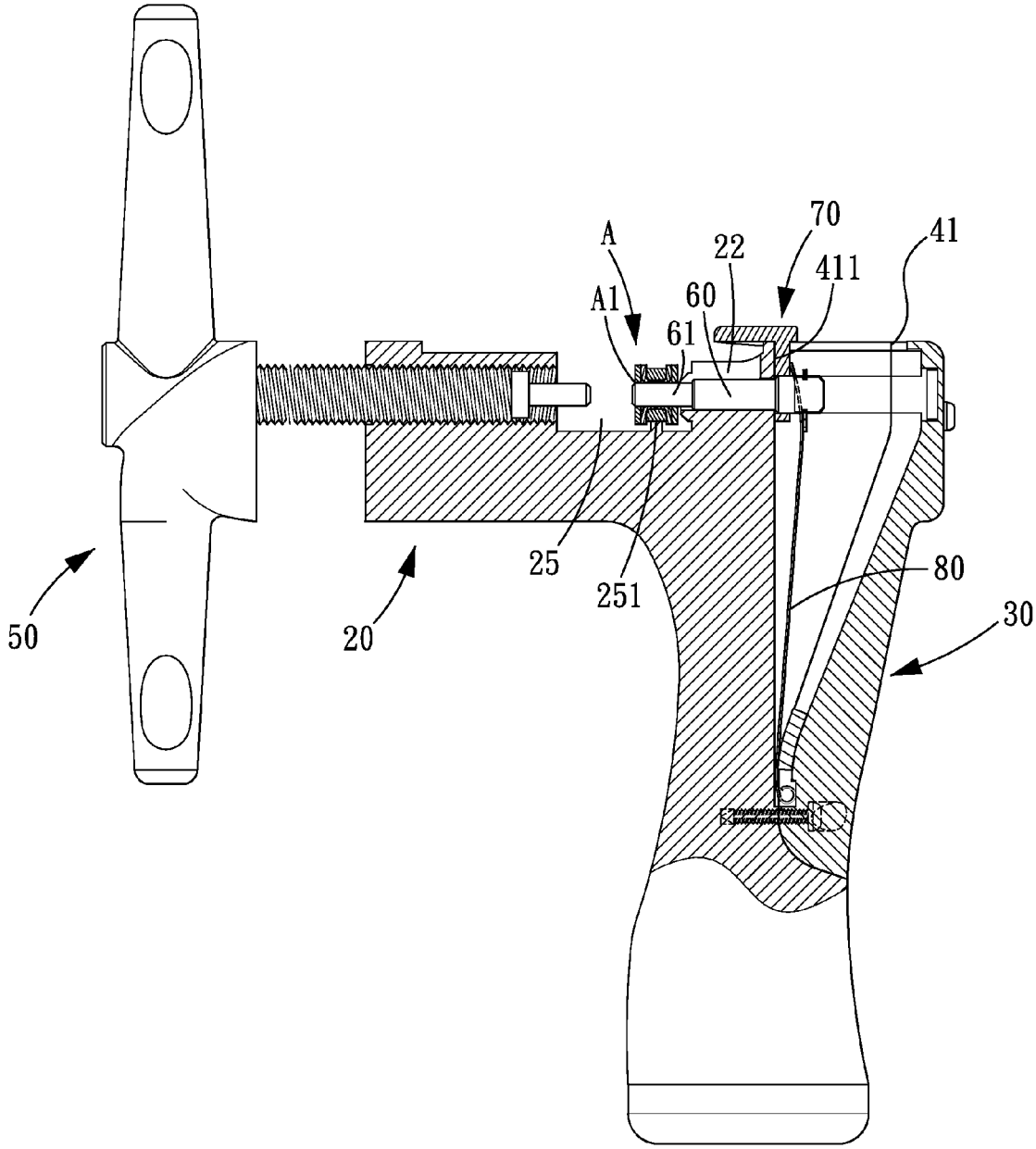
FIG. 8 is an operational view for assembling the two chains, showing that the chains are disposed in the assembling seat and pre-positioned by the rod member in accordance with the present invention.

Subsequently, referring to FIG. 8, after two to-be-assembled chains A are engaged on the positioning protrusion 251 of the assembling space 25, the pulling member 70 will be controlled to not abut against the second surface 412 of the sliding hole 41 any longer, and then the rod member 60 and the pulling member 70 will be pushed back to their original positions by the elastic plate 80 (as shown in FIG. 4), that is to say, the guiding portion 61 of the rod member 60 will extend into the assembling space 25 from the assembling hole 22 of the assembling seat 20 and be inserted between the assembling holes A1 of the two chains A to pre-position the two chains A, additionally, the neck portion 73 of the pulling member 70 will abut against the first surface 411 of the sliding hole 41 to position the pulling member 70.

Figure 9:
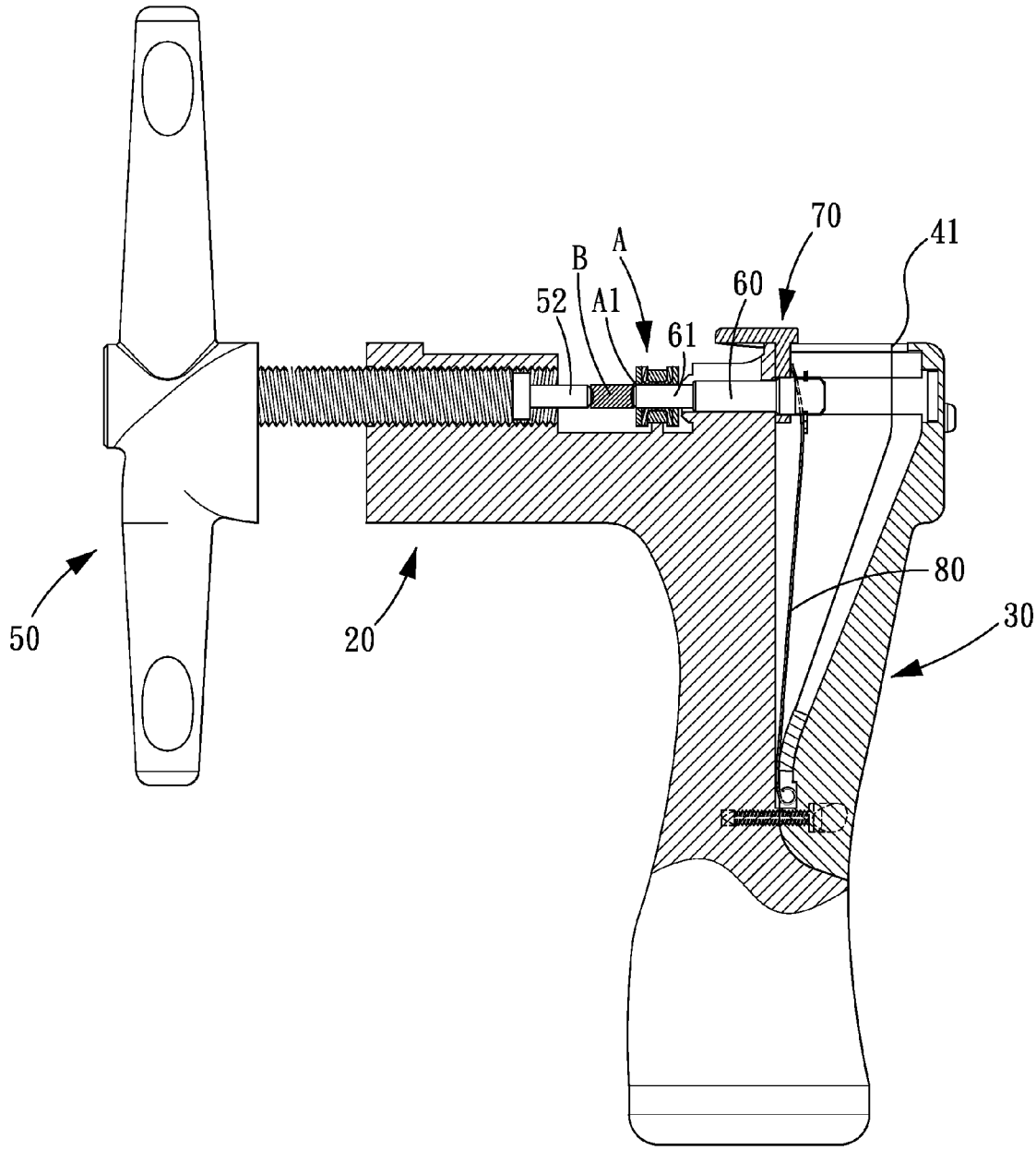
FIG. 9 is an operational view for assembling the two chains, showing a positioning member is located between an actuating member and the rod member in accordance with the present invention.

After that, referring to FIG. 9, a positioning member B will be placed between the guiding portion 61 of the rod member 60 and the pushing member 52 of the actuating member 50 in such a manner that both ends of the positioning member B are pushed against by the pushing member 52 and the guiding portion 61 to keep balance.

Figure 10:
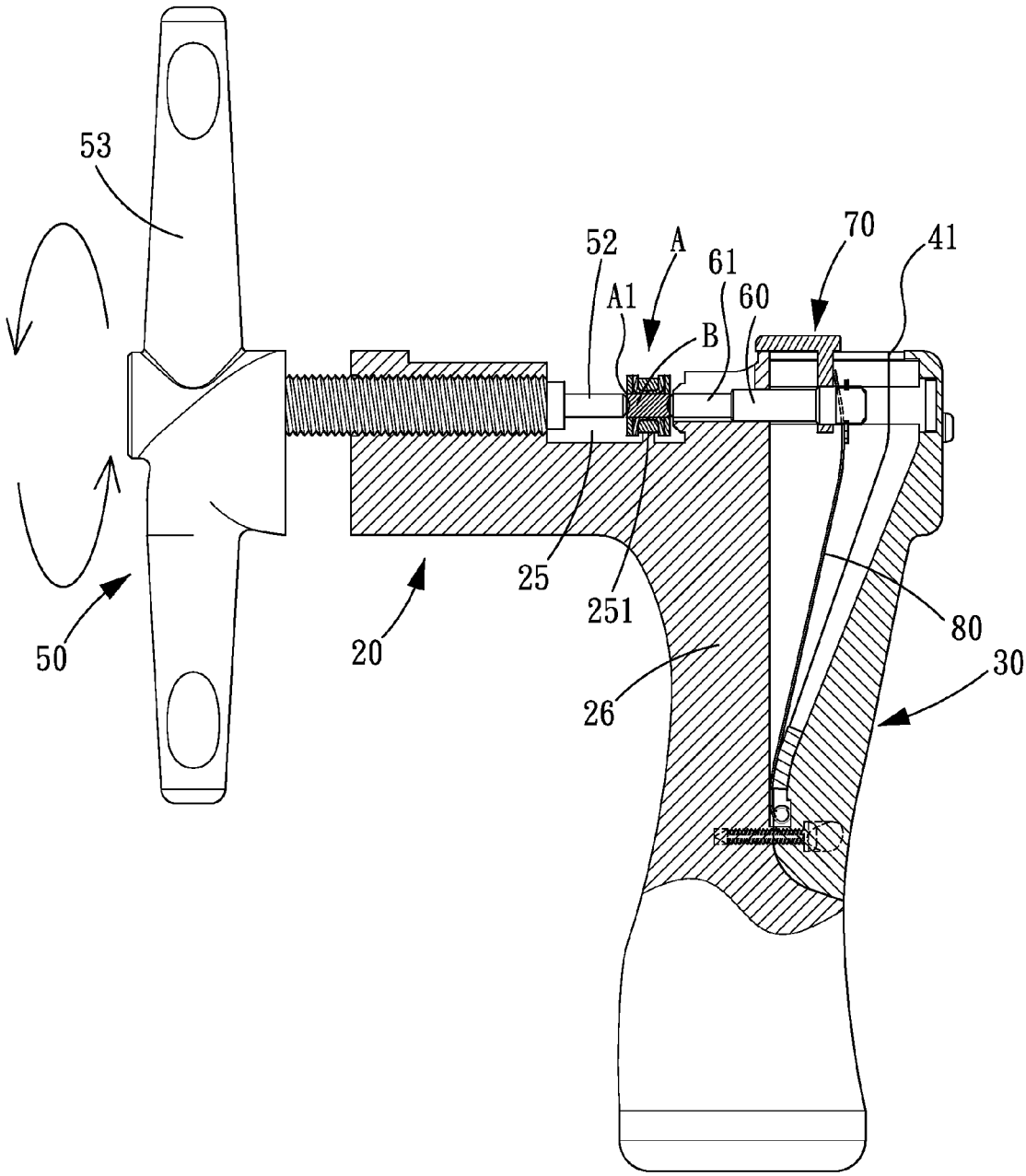
FIG. 10 is an operational view of the chain assembling/disassembling operation in accordance with the present invention, showing that the positioning member is located in the chain.

Finally, referring to FIG. 10, the operating portion 53 of the actuating member 50 will be rotated to make the pushing member 52 move toward the rear cap 30 to push the positioning member B and the rod member 60 toward the rear cap 30, and finally, the positioning member B will be gradually inserted into the assembling holes A1 of the two chains A, and when the positioning member B is completely inserted into the assembling holes A1 of the two chains A, the chain assembly will be finished.

Hence, the present invention not only can pre-insert the guiding portion 61 of the rod member 60 into the assembling holes A1 of the two chains A to pre-position it, but can apply a pushing force to the positioning member B under the effect of the elastic plate 80 to balance the positioning member B when it is ready for assembly, so that when in assembly, the user can hold the handle 26 of the assembling seat 20 with one hand and rotate the operating portion 53 of the actuating member 50 with the other, thus making the assembly of the bicycle chain more convenient and simple.

It is to be noted that, the device of the present invention can also be used to disassemble a bicycle chain, and the difference between the chain assembling method and the chain disassembling method is described as follows.

Referring to FIG. 10, when a chain A is engaged on the positioning protrusion 251 of the assembling space 25 of the assembling seat 20, and the pulling member 70 is controlled to not abut against the second surface 412 of the sliding hole 41 any longer, the rod member 60 will be pushed by the elastic plate 80 to make the guiding portion 61 push against one end of the positioning member B.

Figure 11:
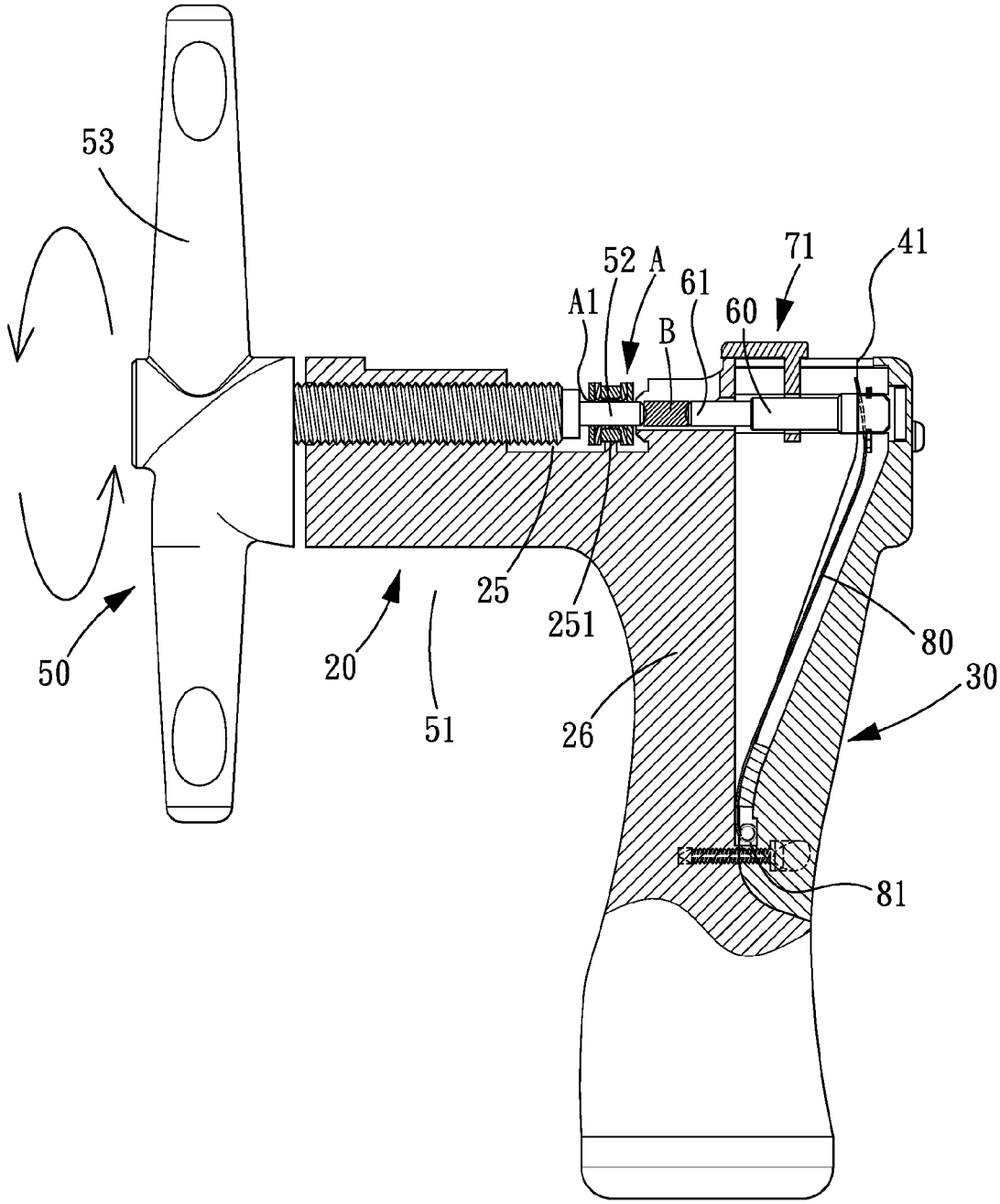
FIG. 11 is an operational view of the chain disassembling operation in accordance with the present invention, showing that the positioning member disengages from the chain.

Referring to FIG. 11, subsequently, the operating portion 53 of the actuating member 50 will be rotated to make the pushing member 52 move toward the rear cap 30, and the pushing member 52 will push the positioning member B to disengage from the assembling holes A1 of the chain A, and the positioning member B will synchronously push the rod member 60 to move toward the rear cap 30. When the positioning member B completely disengages from the assembling holes A1 of the chain A, the disassembly of the chain A will be finished.

While we have shown and described various embodiments in accordance with the present invention, it is clear to those skilled in the art that further embodiments may be made without departing from the scope of the present invention.

What is claimed is:

1. A device for assembling and disassembling a bicycle chain comprising:

a main body including an assembling seat and a rear cap, a threaded hole, an assembling hole, and a sliding hole in communication with the assembling hole being coaxially formed in the assembling seat, a moving space being in communication with the assembling hole and the sliding hole, and an assembling space being located between the threaded hole and the assembling hole;

an actuating member being screwed into the threaded hole;

a rod member being inserted into the assembling hole and including a guiding portion;

a pulling member including a pulling portion and a connecting portion and being slidably disposed in the sliding hole in such a manner that the pulling portion is located outside the sliding hole, and the connecting portion is connected to the rod member; and an elastic plate including a first end and a second end and being assembled in the moving space, the first end being fixedly connected to the main body, and the second end being connected to the rod member, so that the elastic plate provides an elastic restoring force to the pulling member and the rod member;

wherein the assembling seat includes a first sliding groove in communication with the assembling hole, and a first groove in communication with the assembling hole and the first sliding groove, the rear cap includes a second sliding groove and a second groove in communication with the second sliding groove, the second sliding groove and the first sliding groove define the sliding hole, the second groove and the first groove define the moving space;

the sliding hole of the main body includes a first surface and a second surface that are parallel to and staggered with each other, the pulling portion of the pulling member is connected to the connecting portion of the pulling member by a neck portion;

when the guiding portion is located in the assembling hole, and the neck portion abuts against the second surface of the sliding hole, when guiding portion of the rod member is located in the assembling space, the neck portion of the pulling member abuts against the first surface of the sliding hole.

2. The device for assembling and disassembling a bicycle chain as claimed in claim 1, wherein the rod member includes a limiting portion and an end portion connected to the limiting portion, the second end of the elastic plate is connected to the end portion of the rod member, on the end portion of the rod member is provided a retaining ring in such a manner that the second end of the elastic plate is retained between the limiting portion and the retaining ring.

3. The device for assembling and disassembling a bicycle chain as claimed in claim 2, wherein the connecting portion of the pulling member is pivotally connected to the limiting portion of the rod member and aligned with the second end of the elastic plate.

4. The device for assembling and disassembling a bicycle chain as claimed in claim 1, wherein the actuating member includes a threaded portion screwed in the threaded hole, one end of the threaded portion is pivotally connected to a pushing member, the pushing member is capable of being located in the threaded hole and the assembling space, the other end of the threaded portion includes an operating portion.

* * * * *